US005219168A

United States Patent [19]

Morris

[11] Patent Number: 5,219,168

[45] Date of Patent: Jun. 15, 1993

[54] PUZZLE APPARATUS

[76] Inventor: James E. Morris, 12726 Byars Rd., Grandview, Mo. 64030

[21] Appl. No.: 839,104

[22] Filed: Feb. 20, 1992

[51] Int. Cl.[5] ..... A63F 9/10

[52] U.S. Cl. ..... 273/157 R; 273/285

[58] Field of Search ..... 273/157 R, 239, 285; 434/406

[56] References Cited

U.S. PATENT DOCUMENTS

| | | | |
|---|---|---|---|
| 1,430,778 | 10/1922 | Williams | 273/285 |
| 1,781,529 | 11/1930 | Schulman | 273/285 |
| 1,987,496 | 1/1935 | Springborn | 273/157 R |
| 2,002,077 | 5/1935 | Darling et al. | 273/157 |
| 2,084,912 | 6/1937 | Klep | 273/282 |
| 2,364,814 | 12/1944 | Plummer et al. | 273/282 |
| 2,399,041 | 4/1946 | Kleber | 273/285 |
| 2,659,163 | 11/1953 | Albee | 273/157 R |
| 2,984,489 | 5/1961 | Parlato | 273/157 R |
| 3,815,920 | 6/1974 | Carter et al. | 273/157 R |
| 3,836,151 | 9/1974 | Bowerman | 273/286 |
| 3,880,429 | 4/1975 | Blumenaus | 273/285 |
| 4,021,937 | 5/1977 | Kravitz | 273/269 |
| 4,051,607 | 10/1977 | Sullivan | 273/157 R |
| 4,219,194 | 8/1980 | Powers | 273/157 R |
| 4,371,168 | 2/1983 | Dupuis | 273/239 |
| 4,436,307 | 3/1984 | Caldwell | 273/157 R |
| 4,616,832 | 10/1986 | Groner | 273/285 |
| 4,699,385 | 10/1987 | Bifulco | 273/260 |
| 4,865,325 | 9/1989 | Stolz | 273/157 R |
| 5,016,888 | 5/1991 | Huston et al. | 273/239 |

*Primary Examiner*—V. Millin
*Assistant Examiner*—Steven B. Wong
*Attorney, Agent, or Firm*—Hovey, Williams, Timmons & Collins

[57] ABSTRACT

A puzzle apparatus includes an assembly panel and a plurality of puzzle pieces adapted to be assembled in edge-to-edge contact with one another on the panel. At least one holding panel is also provided. The holding panel is connected to the assembly panel and is movable between a closed storage position overlying the assembly panel and an open assembly position exposing the assembly panel. Suitable structure is provided for retaining the pieces on the assembly and holding panels while permitting detachment of the pieces therefrom by manual manipulation of the pieces. Thus, the puzzle pieces remain in contact with the assembly and holding panels until manually repositioned so that if the puzzle is not completed during one sitting it can be stored for future attention.

13 Claims, 2 Drawing Sheets

PUZZLE APPARATUS

BACKGROUND OF THE INVENTION

1. Field of the Invention

The present invention relates generally to games and, more particularly, to a puzzle apparatus that may be stored when not in use to permit easy transportation, and which provides for the retention of puzzle pieces on assembly and holding panels to prevent pieces from being lost or shifted from a desired position.

2. Discussion of the Prior Art puzzles have been a popular game form for many years, space requirements associated with conventional puzzles have prevented them from gaining widespread use by potential users in confined environments such as by patients confined to hospital beds, or by travelers. Further, time constraints have kept puzzles from becoming a popular form of entertainment for travelers and other potential users who have only occasional opportunities to assemble puzzles, and who do not have a single span of time to complete an entire puzzle.

OBJECTS AND SUMMARY OF THE INVENTION

It is an object of the present invention to provide a puzzle apparatus that may be used in confined environments and which permits a user to store the puzzle with the pieces arranged in any desired formation and to resume assembly at a later date without upsetting the progress made prior to storage.

Another object of the present invention resides in providing a puzzle apparatus having an assembly panel on which the puzzle may be assembled and which retains puzzle pieces thereon to prevent shifting or loss of the assembled pieces. In achieving this object of the invention it is also desirable to provide holding panels on which unassembled pieces may be stored and retained.

In accordance with these and other objects evident from the following detailed description of a preferred embodiment of the invention, a puzzle apparatus comprises a plurality of puzzle pieces adapted to be assembled in edge-to-edge contact with one another, and an assembly panel on which the pieces may be assembled. At least one holding panel is provided on which unassembled pieces may be positioned. The holding panel is connected to the assembly panel and is movable between a closed storage position overlying the assembly panel and an open assembly position exposing the assembly panel. Retention means are provided for retaining the pieces on the assembly and holding panels while permitting detachment of the pieces therefrom by manual manipulation of the pieces.

By constructing a puzzle apparatus in accordance with the present invention numerous advantageous results are achieved. For example, by providing means for retaining pieces on the assembly and holding panels, it is possible to easily transport the apparatus in an assembled, unassembled, or even partially assembled condition, while maintaining the layout of the pieces on the panels to preserve the progress made by a user prior to storage.

Further, the assembly and holding panels together define a substrate on which the pieces may be arranged and the puzzle assembled, so that a person confined to a location normally unsuited to the use of a puzzle, such as a hospital patient or a traveler, is provided with a surface on which to work the puzzle. The assembly and holding panels also may be folded to a storage position while the pieces are retained thereon in order to permit compact storage and transportation of the puzzle.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENTS

Figure 2:
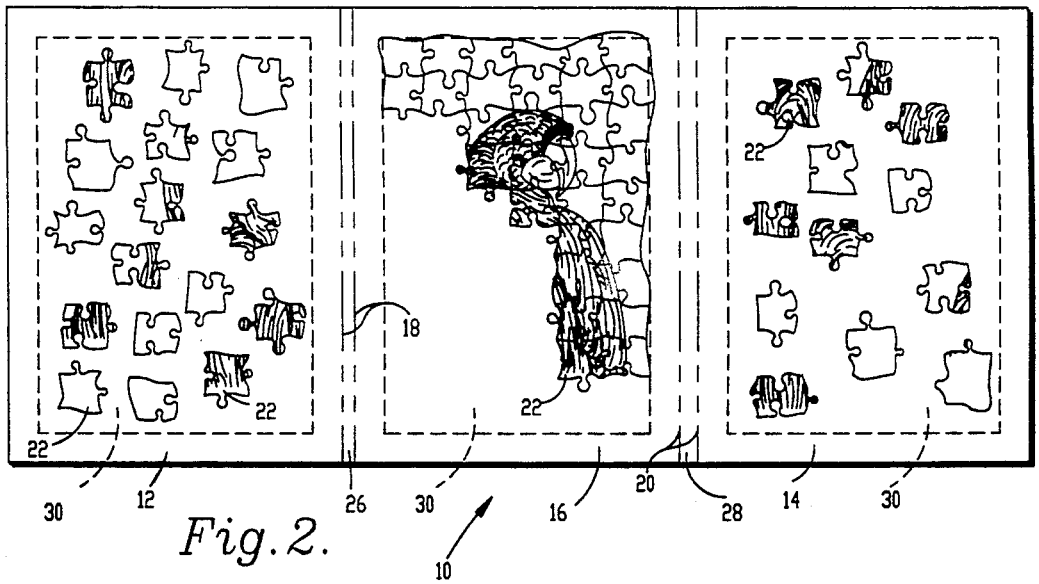
FIG. 2 is a top plan view of a puzzle apparatus constructed in accordance with a first preferred construction.

A puzzle apparatus fabricated in accordance with a first preferred construction of the invention is illustrated in FIG. 2, and includes a folder 10 separated into three side-by-side panels 12, 14, 16 by a plurality of lines of weakening 18, 20. Preferably, the central panel 16 is designated as an assembly panel and the two side panels 12, 14 are designated as holding panels.

A plurality of puzzle pieces 22 are provided which are adapted to be assembled in edge-to-edge contact with one another on the assembly panel 16. When assembled, designs provided on each of the pieces align with designs provided on adjacent pieces to complete an image.

Figure 3:
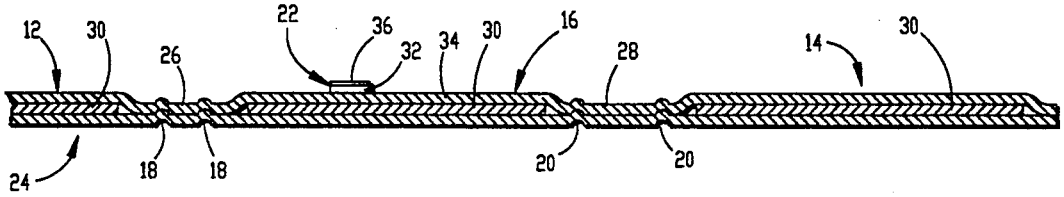
FIG. 3 is a side sectional view of the puzzle apparatus shown in FIG. 2.

Turning to FIG. 3, the folder is illustrated as including a cover sheet 24 which may be formed of any suitable sheet material capable of protecting the puzzle and of supporting the pieces within the folder. For example, solid paper board such as a sheet of cast coated paper board may be employed as the cover sheet.

Figures 4, 5, 6, 7, 8, 9:
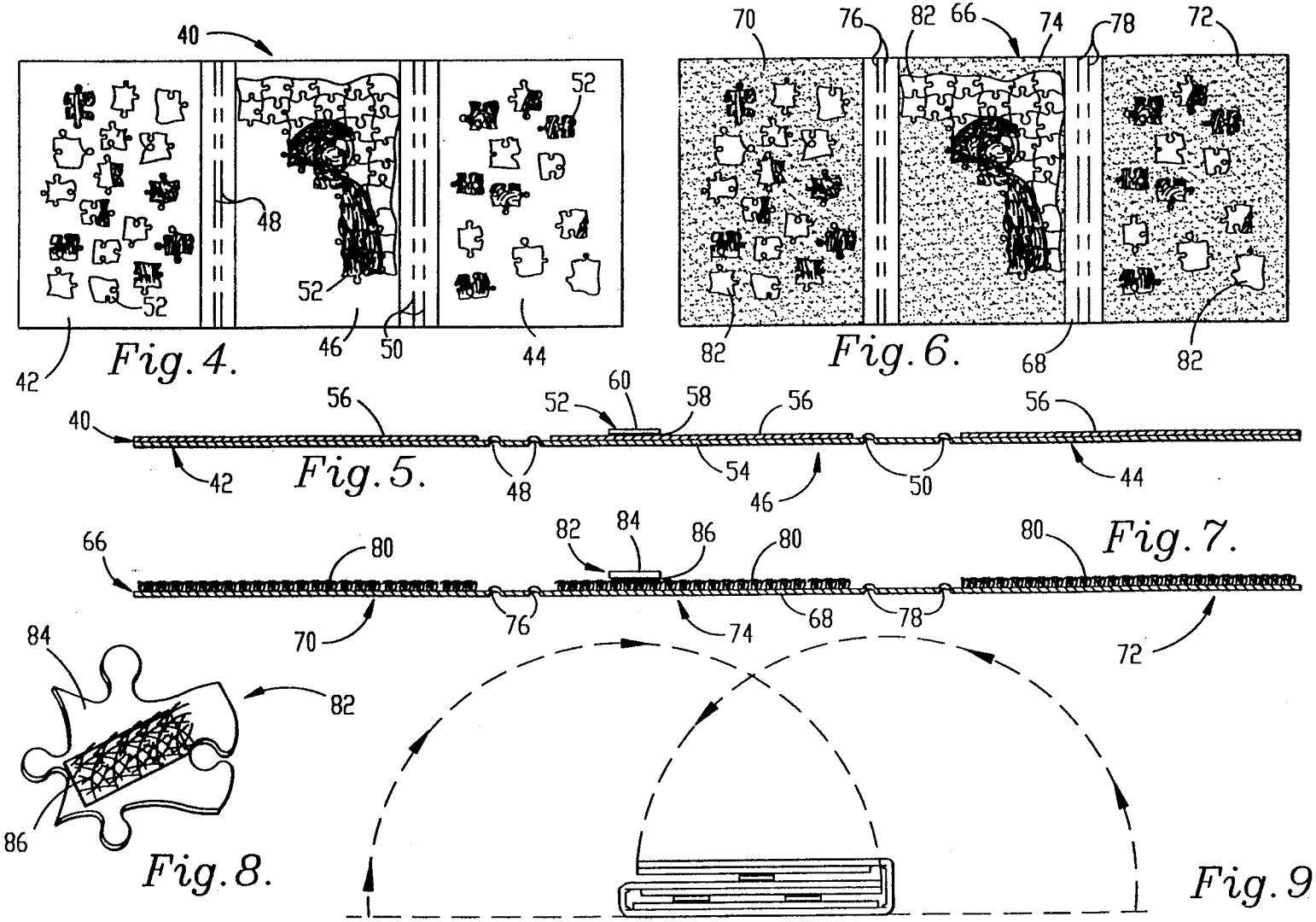
FIG. 4 is a top plan view of a puzzle apparatus constructed in accordance with a second preferred construction.
FIG. 5 is a side sectional view of the puzzle apparatus illustrated in FIG. 4.
FIG. 6 is a top plan view of a puzzle apparatus constructed in accordance with a third preferred construction.
FIG. 7 is a side sectional view of the puzzle apparatus shown in FIG. 6.
FIG. 8 is a perspective view of a puzzle piece constructed in accordance with the third preferred construction.
FIG. 9 is a side elevational view of a puzzle apparatus constructed in accordance with the present invention, illustrating a storage position of the apparatus.

The lines of weakening 18, 20 are preferably formed in the cover sheet 24 by cut scoring or crease scoring the paper board, and the lines of weakening 18 between the assembly panel and the left-hand holding panel 12 are closer together than the lines of weakening 20 between the assembly panel and the right-hand holding panel 14. By forming the lines of weakening in this manner, the left-hand holding panel may be folded in on the assembly panel prior to folding of the right-hand panel, and the right-hand panel may then be folded over the left-hand panel, as illustrated in FIG. 9. Of course, it is understood that this construction could be reversed, with the lines of weakening formed to permit folding of the right-hand panel first.

The spline 26 defined between the lines of weakening 18 is large enough to accommodate folding of the panels 12, 16 together with puzzle pieces supported on both panels Opposite one another. The spline 28 defined by the lines of weakening 20 is large enough to accommodate folding of the right-hand panel over both the left-hand panel and the assembly panel even when puzzle pieces are provided on all three panels.

The puzzle apparatus is provided with retention means for retaining the pieces on the assembly and holding panels while permitting detachment of the pieces therefrom by manual manipulation of the pieces. The pieces are retained on the assembly and holding panels regardless of the position of the holding panels relative to the assembly panel. For example, the pieces remain in place during assembly of the puzzle to prevent the pieces from being shifted or lost, and are retained during movement of the panels to the closed storage position in order to preserve progress made by the user.

According to the first preferred construction, the retention means includes a sheet 30 of magnetically conductive material secured to each of the panels 12, 14, 16 and covering a substantial portion of the region defined by each of the panels. A layer of magnetic material 32 is provided on each of the pieces 22 and the magnetic material 32 is attracted to the sheets 30 by the magnetic force of the material.

Preferably, a protective sheet 34 of paper or the like overlies the sheets 30 of magnetically conductive material and is affixed to the cover sheet 24 to help retain the magnetically conductive material on the cover sheet and to shield all of the edges of the material from contact by a user. Where sheet metal is used as the material, the use of the protective sheet prevents users from being cut by the edge of the material or from picking up slivers off of the material.

Although the pieces 22 may be formed from a sheet of magnetic material of the type conventionally used by crafters, with the design printed directly on the material, preferably a sheet of fibrous material 36 is affixed to one surface of the magnetic material 32 with the design printed on the sheet of fibrous material. Further, it is possible to form the puzzle pieces of magnetically conductive material, and to provide magnetic material on each of the panels 12, 14, 16.

Figure 1:
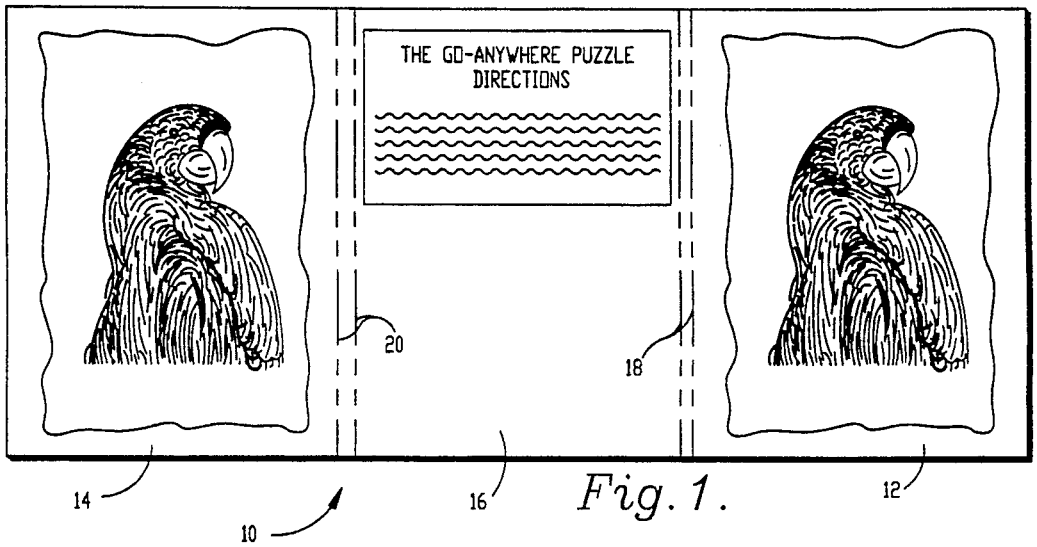
FIG. 1 is a bottom plan view of a puzzle apparatus constructed in accordance with the preferred embodiment of the present invention.

In use, the magnetic pieces 22 are arranged in a random fashion on the holding panels 12, 14 and the folder 10 is closed so that the puzzle pieces are protected therein, as shown in FIG. 9. Returning to FIG. 1, the folder is provided with an illustration of the puzzle image on the back of each of the holding panels 12, 14 so that a purchaser is able to select a desired puzzle. Further, during assembly of the puzzle, either of the holding panels may be folded over the assembly panel to display the image so that a user may refer to the illustrations while assembling the puzzle.

The assembly panel 16 may be provided with any convenient message or indicia, such as directions for completing the puzzle or an advertisement for a product to be promoted thereby.

Returning to FIG. 2, during assembly of the puzzle, a user manually detaches a piece 22 from one of the holding panels 12, 14 by exerting a force on the piece sufficient to overcome the magnetic attraction between the magnetic material 32 on the piece and the magnetically conductive material 30 of the holding panel. Thereafter, the piece is positioned on the assembly panel 16 and is retained in position by the magnetic attraction between the magnetic material of the piece and the magnetically conductive material of the assembly panel.

If a user desires to store the puzzle during assembly, he or she may simply fold the left-hand holding panel and then the right-hand holding panel over the assembly panel, as shown in FIG. 9, so that the folder is of a size that may be conveniently stored in a purse or briefcase. Because the pieces are retained in their last arranged positions, the progress made by the user is preserved until the folder is reopened at a later time.

A second preferred construction of the invention is illustrated in FIGS. 4 and 5. As shown in FIG. 4, the apparatus is similar to the first preferred construction in most respects, including the use of a folder 40 formed by a cover sheet 54 provided with a central assembly panel 46 and two adjoining holding panels 42, 44, separated from one another by lines of weakening 48, 50.

Turning to FIG. 5, it can be seen that a sheet of static vinyl 56 or the like is affixed to the cover sheet 54 on each panel and covers at least a substantial portion of the region defined by each panel 42, 44, 46. The static vinyl material is of a type manufactured to adhere to any polished surface such as window glass, mirrors, etc., without the need for adhesives. However, any other suitable material which creates static attraction or an affinity between itself and another material may be used.

Each puzzle piece 52 is provided with a layer of material 58 which is attracted to the vinyl when pressed against the vinyl. For example, a standard cast coated paper board having a smooth surface may be used in the puzzle pieces to provide a surface that will have an affinity for the vinyl. An additional layer of fibrous material 60 may be provided, if desired, and a design is printed on each piece opposite the smooth surface, as shown in FIG. 4. It is understood that the vinyl material may be applied to the puzzle pieces, with each of the panels 42, 44, 46 being coated with cast coated paper board or the like, while achieving the same type of attraction between the pieces and the panels.

In use, assembly of the puzzle proceeds as in the first preferred construction, with a user manually pulling a piece 52 from one of the holding panels 42, 44 and pressing the piece onto the assembly panel 46 at a desired position. The pieces are retained on the assembly and holding panels by the affinity between the pieces 52 and the vinyl 56 provided on the panels.

According to a third preferred construction, as shown in FIGS. 6 and 7, a folder 66 is constructed as described above, including a cover sheet 68 provided with a central assembly panel 74 and two adjoining holding panels 70, 72, separated from one another by lines of weakening 76, 78.

A sheet or layer of conventional hook material 80, such as a hook material marketed under the name VELCRO, is affixed to the cover sheet 68 and covers a substantial portion of the region defined by each of the panels 70, 72, 74. As shown in FIG. 8, each of the puzzle pieces 82 provided with the puzzle are formed from one or more layers of fibrous material 84, and a piece of loop material 86 of conventional construction is affixed to the bottom side of each piece so that the pieces may be retained in position by the interengagement of the hook and loop materials. The positioning of the hook and loop materials may, of course, be reversed without departing from the scope of this preferred construction of the invention.

As shown in FIG. 6, the top side of each piece is provided with a design so that an image is formed when the pieces are assembled in a predetermined arrangement.

In use, a piece 82 is manually pulled from one of the holding panels 70, 72 by a exerting a force on the piece sufficient to loosen the interengagement between the hook and loop material, and the piece is repositioned on the assembly panel 74 by pressing the piece onto the hook material.

In connection with any of the previously described constructions, an envelope may be provided within which the puzzle apparatus of the present invention may be stored when folded. Further, although three preferred constructions are described for providing retention of the pieces on the assembly and holding panels, it is understood that other means may be employed so long as such means permit retention of the pieces both during assembly and storage of the puzzle. Also, although the puzzles are illustrated as being shaped to permit inter-locking edge-to-edge contact with adjacent pieces, it is possible to form the pieces of any desired shape.

Although the invention has been described with reference to the illustrated constructions of the preferred embodiment, it is understood that substitutions may be made and equivalents employed herein without departing from the scope of the invention as recited in the claims.

What is claimed is:

1. A puzzle apparatus comprising:

a plurality of puzzle pieces adapted to be assembled in edge-to-edge contact with one another to form a single puzzle;

a central assembly panel on which the pieces may be assembled;

at least two holding panels each including a front surface on which unassembled pieces may be positioned, the holding panels each being connected to the assembly panel and being movable between a closed storage position overlying the assembly panel and an open assembly position exposing the assembly panel, the holding panels each including a back surface provided with an illustration representative of the assembled puzzle such that, during assembly of the puzzle, either of the holding panels may be folded over the assembly panel to display the illustration so that a user may refer to the back surface of either holding panel while assembling the puzzle; and retention means for retaining the pieces on the assembly and holding panels while permitting detachment of the pieces therefrom by manual manipulation of the pieces.

2. The puzzle apparatus as recited in claim 1, wherein the holding and assembly panels are connected together by a pair of splines each provided between two of the panels.

3. The puzzle apparatus as recited in claim 1, wherein the retention means provides magnetic attraction between the pieces and the assembly and holding panels to retain the pieces thereon.

4. The puzzle apparatus as recited in claim 3, wherein the assembly and holding panels are each provided with a sheet of magnetically conductive material and each of the pieces are provided with a layer of magnetic material.

5. The puzzle apparatus as recited in claim 4, further comprising a protective sheet overlying the sheets of magnetically conductive material in the assembly and holding panels.

6. The puzzle apparatus as recited in claim 4, wherein the pieces are each provided with a design printed directly on the layer of magnetic material.

7. The puzzle apparatus as recited in claim 4, wherein the pieces are each provided with a layer of fibrous material affixed to the layer of magnetic material and a design is provided on the layer of fibrous material.

8. The puzzle apparatus as recited in claim 1, wherein the retention means provides electrostatic attraction between the pieces and the assembly and holding panels to retain the pieces thereon.

9. The puzzle apparatus as recited in claim 8, wherein the assembly and holding panels as well as the pieces are each provided with a layer of sheet material having an affinity for similar material such that the pieces are attracted to and retained by the assembly and holding panels.

10. The puzzle apparatus as recited in claim 9, wherein the pieces are each provided with a layer of fibrous material affixed to the sheet material and a design is provided on the layer of fibrous material.

11. The puzzle apparatus as recited in claim 1, wherein the retention means provides mechanical connection between the pieces and the assembly and holding panels to retain the pieces thereon.

12. The puzzle apparatus as recited in claim 1, wherein the retention means includes cooperative hook and loop materials provided on the assembly and holding panels and on the pieces.

13. A puzzle apparatus comprising:

a plurality of puzzle pieces adapted to be assembled in edge-to-edge contact with one another to form a single puzzle;

an assembly panel on which the pieces may be assembled;

a pair of holding panels each including a front surface on which unassembled pieces may be positioned, the assembly holding panels being formed of a single sheet of fibrous material provided with a plurality of lines of bweakness separating the assembly panel from the holding panels and permitting the holding panels to be moved between a closed storage position overlying the assembly panel and an open assembly position exposing the assembly panel, the holding panels each including a back surface provided with an illustration representative of the assembled puzzle such that, during assembly of the puzzle, either of the holding panels may be folded over the assembly panel to display the illustration so that a user may refer to the back surface of either holding panel while assembling the puzzle; and retention means for retaining the pieces on the assembly and holding panels while permitting detachment of the pieces therefrom by manual manipulation of the pieces.

* * * * *